US007198069B1

(12) United States Patent
Griffith

(10) Patent No.: US 7,198,069 B1
(45) Date of Patent: Apr. 3, 2007

(54) DEVICE AND METHOD FOR ROTARY MANIPULATION OF A PLURALITY OF WIRES

(76) Inventor: Karl Griffith, 5109 Beverly Rd., Brooklyn, NY (US) 11203

( * ) Notice: Subject to any disclaimer, the term of this patent is extended or adjusted under 35 U.S.C. 154(b) by 194 days.

(21) Appl. No.: 10/741,341

(22) Filed: Dec. 19, 2003

(51) Int. Cl.
*B21F 7/00* (2006.01)

(52) U.S. Cl. ..... 140/119; 140/149

(58) Field of Classification Search ..... 140/121, 140/118, 119, 123, 149; 81/300, 318, 415, 81/417, 427, 416, 418; 269/254 CS; D8/52
See application file for complete search history.

(56) References Cited

U.S. PATENT DOCUMENTS 1,377,373 A * 5/1921 Urie ..... 140/119
1,845,951 A 2/1932 Worsham
2,737,983 A * 3/1956 Pray ..... 140/118
2,964,069 A * 12/1960 Chappel et al. ..... 140/119
5,560,402 A * 10/1996 Bates ..... 140/118
5,678,400 A 10/1997 Heard
5,853,033 A * 12/1998 Kavanagh ..... 140/123
5,904,078 A * 5/1999 Gustafson et al. ..... 81/417
2003/0154552 A1* 8/2003 Oka ..... 7/127

* cited by examiner

*Primary Examiner*—Lowell A. Larson
*Assistant Examiner*—Debra Wolfe

(57) ABSTRACT

A device and method for rotary manipulation of a plurality of wires for untwisting wires in armor shielded electrical cable installations. The device and method for rotary manipulation of a plurality of wires includes a shank portion, a pair of opposing jaw members, and a biasing member. The shank portion is designed for being received in a chuck of the conventional reversible drill. The pair of opposing jaw members are operationally coupled to the shank portion. Preferably, each one of the pair of opposing jaw members includes an arm portion and a face portion designed for engaging a plurality of wires. The biasing member urges a first one of the pair of opposing jaw member to abut a second one of the pair of opposing jaw members.

12 Claims, 3 Drawing Sheets

DEVICE AND METHOD FOR ROTARY MANIPULATION OF A PLURALITY OF WIRES

BACKGROUND OF THE INVENTION

1. Field of the Invention

The present invention relates to wire twisting devices and more particularly pertains to a new device and method for rotary manipulation of a plurality of wires for untwisting cables wire in armor shielded electrical cable installations.

2. Description of the Prior Art

The use of wire twisting devices is known in the prior art. Illustrative examples include U.S. Pat. No. 1,845,951; U.S. Pat. No. 5,678,400; and U.S. Pat. No. 5,853,033.

While these devices fulfill their respective, particular objectives and requirements, the need remains for a device and method that utilizes a clamping arrangement to speed the engagement of disengagement of the wires being manipulated, as well as a small device which can be used in conjunction with a conventional reversible drill in physically constrained areas.

SUMMARY OF THE INVENTION

Electricians work with blueprints when they install electrical systems in factories, office buildings, homes, and other structures. Blueprints indicate the location of circuits, outlets, load centers, panel boards, and other equipment. In factories and offices, they first place conduit (pipe or tubing) inside designated partitions, walls or other concealed areas. They also fasten to the wall small metal or plastic boxes that will house electrical switches and outlets. They then pull insulated wires or cables to complete circuits between these boxes. In addition to wiring a building's electrical system, electricians may install coaxial or fiber optic cable for computers and other telecommunications equipment. A growing number of electricians install telephone and computer wiring and equipment. Armor shielded cable is widely used in many applications, the steel or aluminum interlocked metallic sheath providing mechanical protection with design flexibility to provide a cost-efficient alternative to cables in conduit. In addition to mechanical protection, armored cable also offers protection against electromagnetic interference (EMI). After an armored cable has been routed to a distribution panel or junction box, the metal shielding must be removed to configure and connect the individual wires. Before this can be accomplished, after the shielding has been removed, the individual wires, which are twisted together, must be unwound and separated from each other. This is a tedious and time consuming task. The present invention addresses this task making it much easier and less time consuming by providing a device which would be used in conjunction with a reversible drill.

The present invention is a special purpose tool that is designed for the specific function of unwinding and separating twisted wires, after an armored sheath has been removed. The device would be used in conjunction with an electrically operated, reversible drill. The approximate dimensions of the device are 4 to 5" (four to five inches) in length an ½ to 1" (one half to one inch) in width. The invention is a clamping device that is comprised of two metal arms that are joined together by a securing rivet and high tensile spring. The upper end of each arm features a rounded node, or jaw, with flat gripping surface that projects inward toward the opposite arm. When the device is not being used, the flat gripping surfaces of the two jaws would be firmly abutted together, due to the pressure being exerted by the high tensile spring. The lower ends of the arms are configured in a criss-cross manner, the lower end of one arm extending vertically downward, the lower end of the opposite arm extending downward and outward at an approximate 45 degree angle. It should be noted that the handle arm that extends vertically downward is a circular rod. The lower ends of the two arms form the gripping handle which would be grasped by the user when the device is to be used. With the handle grasped, pressure would then be exerted on the handle to open the jaws and the wires that are to be untwisted inserted between the jaws. The metal shielding would, of course, have been previously removed. Pressure would then be removed from the high tensile spring by releasing the handle and allowing the two jaws to mesh together, the wire held in place by the pressure exerted on the jaws by the high tensile spring. The arm of the handle which extends vertically downward, the circular rod, would then be inserted into the drill chuck of reversible drill and the chuck tightened. The drill would then be operated, in reverse, to quickly and easily untwist and separate the individual wires. The invention is a basic but effective tool that would save electricians and do-it-yourselfers a lot of time whenever they work with armored cable.

To this end, the present invention generally comprises a shank portion, a pair of opposing jaw members, and a biasing means. The shank portion designed for is received in a chuck of the conventional reversible drill. The pair of opposing jaw members are operationally coupled to the shank portion. Preferably, each one of the pair of opposing jaw members includes an arm portion and a face portion designed for engaging a plurality of wires. The biasing means urges a first one of the pair of opposing jaw member to abut a second one of the pair of opposing jaw members.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
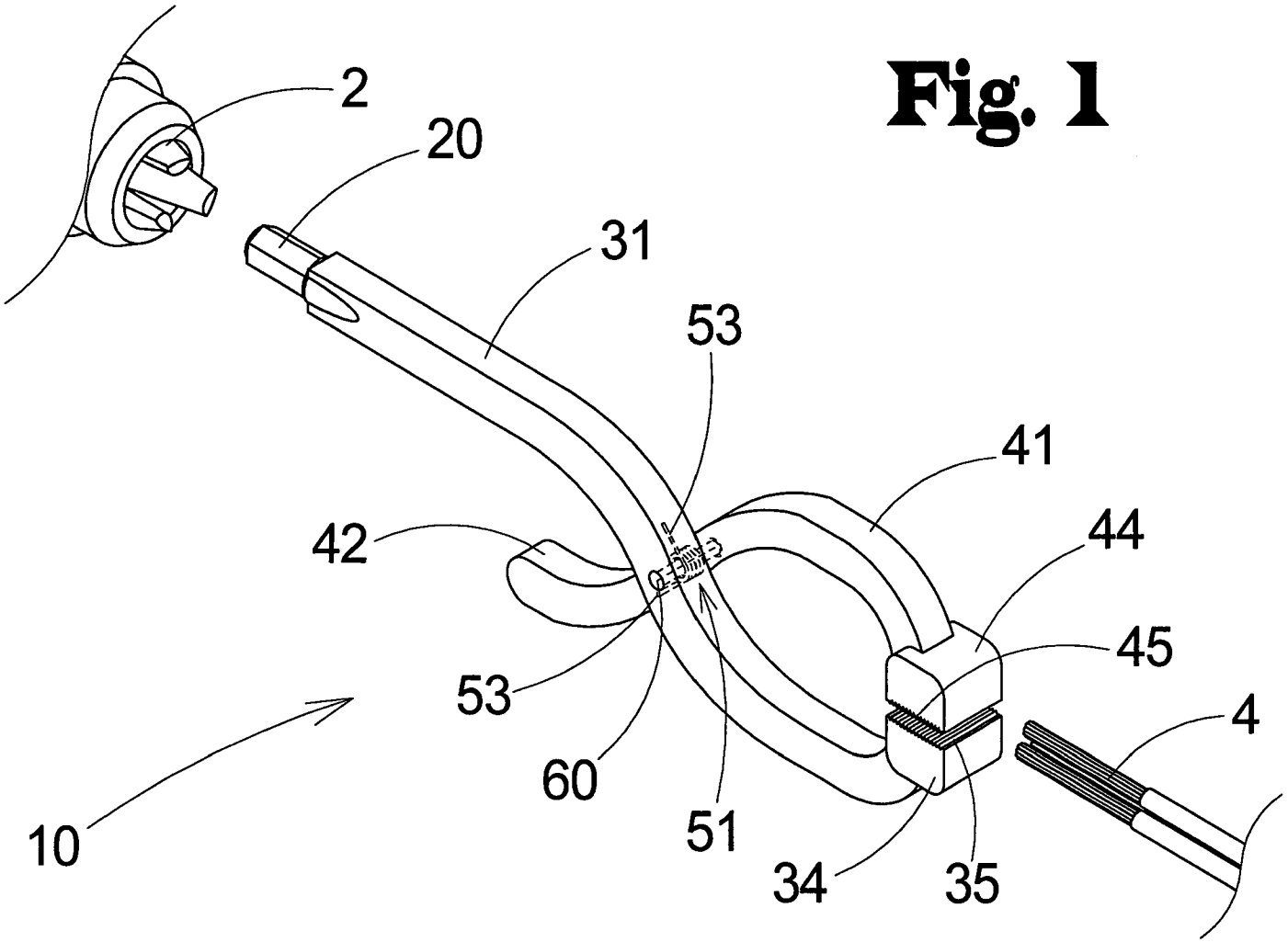
FIG. 1 is a schematic perspective view of a new device and method for rotary manipulation of a plurality of wires according to the present invention.
Figure 2:
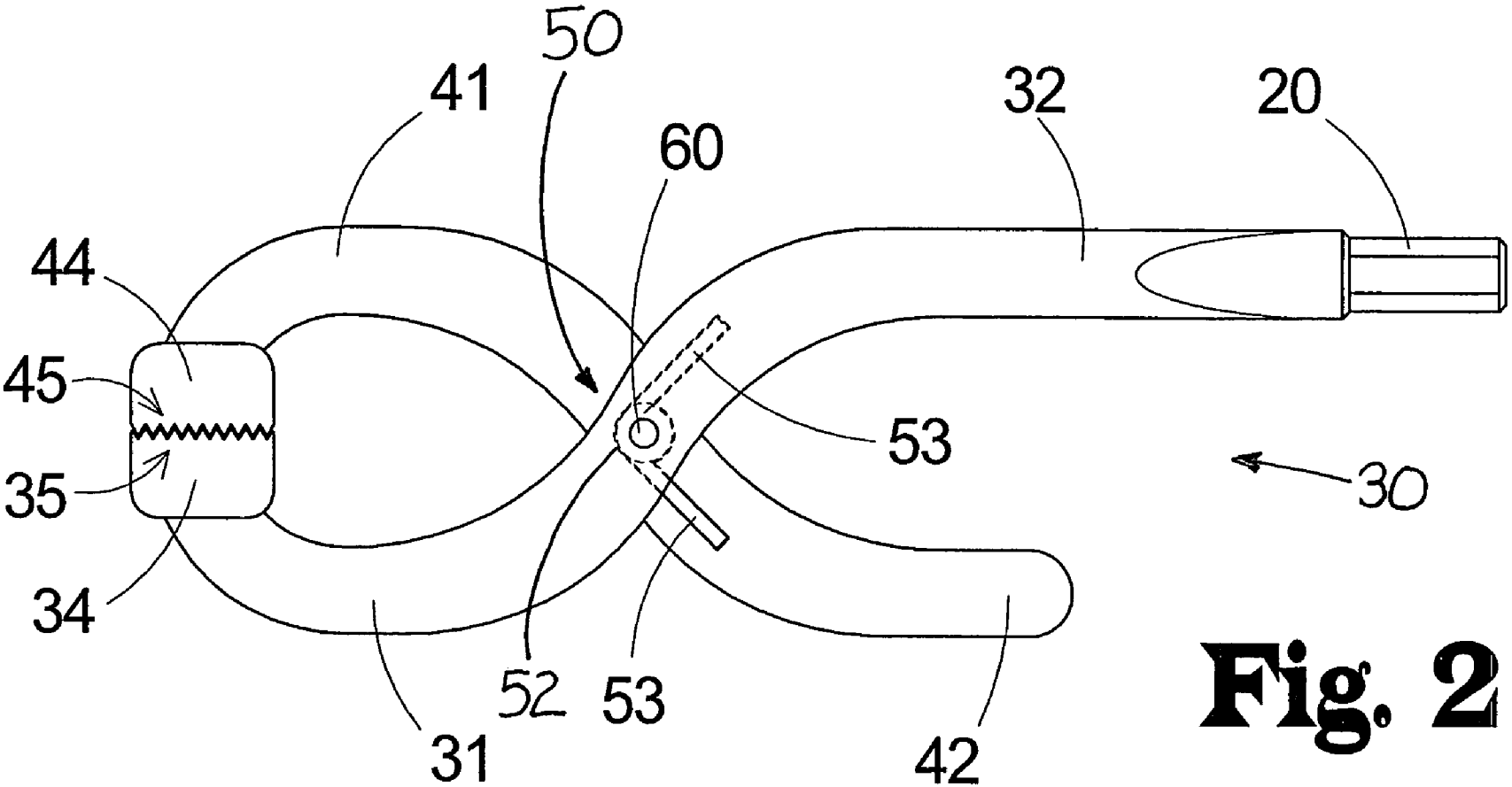
FIG. 2 is a schematic side view of the present invention.
Figure 3:
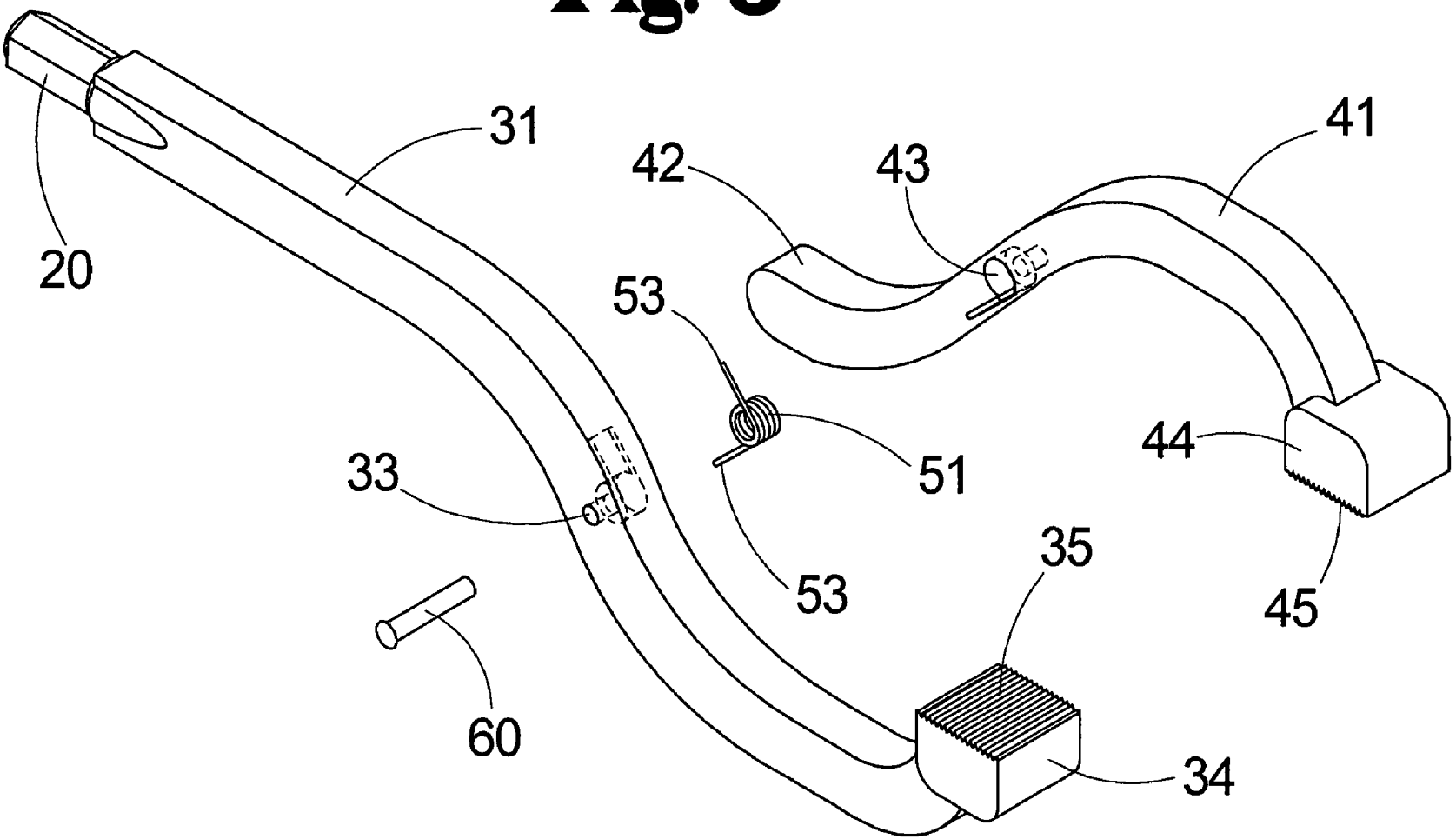
FIG. 3 is a schematic exploded view of the present invention.

With reference now to the drawings, and in particular to FIGS. 1 through 3 thereof, a new device and method for rotary manipulation of a plurality of wires embodying the principles and concepts of the present invention and generally designated by the reference numeral 10 will be described.

As best illustrated in FIGS. 1 through 3, the device and method for rotary manipulation of a plurality of wires 10 generally comprises a shank portion 20, a pair of opposing jaw members 30, and a biasing means 50.

The shank portion 20 designed for being received in a chuck of the conventional reversible drill 2. The pair of opposing jaw members 30 is operationally coupled to the shank portion 20. Preferably, each one of the pair of opposing jaw members 31, 41 includes an arm portion 32,42 and a face portion 34,44 designed for engaging a plurality of wires 4.

The biasing means 50 urges a first one 31 of the pair of opposing jaw members 30 to abut a second one 41 of the pair of opposing jaw members 30.

In a preferred embodiment, the arm portion 32,42 includes an aperture 33,43 extending therethrough, and a rivet member 60 is used for pivotally securing a first one 31 of the pair of opposing jaw members 30 to a second one 41 of the pair of opposing jaw members 30. The rivet member 60 is positioned through each one of the apertures 33,43.

In a further embodiment, the biasing means 50 is a tension spring 51 with a coil portion 52 and a pair of arm members 53. The rivet member 60 is positioned through the coil portion 52. The arm members 53 urge the arm portions 32,42 of the opposing jaw members 30 apart. Thus, the face portions 34,44 are urged together.

In still a further embodiment, each one of the face portions 34,44 further comprises a plurality of ridges 35,45 for enhancing a frictional engagement between the face portion 34,44 and the plurality of wires 4 being grasped.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A device for rotary manipulation a plurality of wires in conjunction with a reversible drill, comprising:

a shank portion having an exterior surface configured to be received in and engaged by a chuck of the reversible drill;

a pair of opposing jaw members pivotally mounted to each other, each of said jaw portions having a first end with a face portion for selectively abutting against the face portion of the other one of the jaw portions, each of said jaw portions having a second end opposite of the first end; and a biasing means urging a first one of said pair of opposing jaw member to abut a second one of said pair of opposing jaw members;

wherein said shank portion is integrally coupled to the second end of one of said jaw members and extends longitudinally of said one jaw member such that rotation of said shank portion rotates said one jaw member and the other said jaw member;

wherein said pair of opposing jaw members form a substantially X-shaped configuration.

2. The device of claim 1, wherein said shank portion has an exterior surface, and said exterior surface has a hexagonal cross sectional shape.

3. The device of claim 1, further comprising:

each of said pair of opposing jaw members having an arm portion, said face portion being adapted for engaging a plurality of wires;

said arm portion having an aperture extending therethrough; and a rivet member for pivotally securing a first one of said pair of opposing jaw members to a second one of said pair of opposing jaw members, said rivet member being positioned through each one of said apertures.

4. The device of claim 1, wherein said biasing means further comprises a tension spring having a coil portion and a pair of arm members, said rivet member being positioned through said coil portion, said arm members urging said face portions of said jaw members together.

5. The device of claim 1, wherein each of said face portions includes a plurality of ridges for enhancing an engagement between said face portion and the plurality of wires being grasped.

6. The device of claim 1, wherein said shank portion has an exterior surface, and said exterior surface has a hexagonal cross sectional shape;

each of said pair of opposing jaw members having an arm portion, said face portion being adapted for engaging a plurality of wires;

said arm portion having an aperture extending therethrough;

a rivet member for pivotally securing a first one of said pair of opposing jaw members to a second one of said pair of opposing jaw members, said rivet member being positioned through each one of said apertures;

wherein said biasing means further comprises a tension spring having a coil portion and a pair of arm members, said rivet member being positioned through said coil portion, said arm members urging said face portions of said jaw members together; and wherein each of said face portions includes a plurality of ridges for enhancing an engagement between said face portion and the plurality of wires being grasped.

7. In combination:

a reversible drill having a rotatable chuck; and a device for rotary manipulation a plurality of wires removably mounted on said chuck of said reversible drill, said device comprising:

a shank portion releasably engaged by the chuck of said reversible drill;

a pair of opposing jaw members pivotally mounted to each other, each of said jaw portions having a first end with a face portion for selectively abutting against the face portion of the other one of the jaw portions, each of said jaw portions having a second end opposite of the first end; and a biasing means urging a first one of said pair of opposing jaw member to abut a second one of said pair of opposing jaw members;

wherein said shank portion is integrally coupled to the second end of one of said jaw members and extends longitudinally of said one jaw member such that rotation of said shank portion rotates said one jaw member and the other said jaw member;

wherein said pair of opposing jaw members form a substantially X-shaped configuration.

8. The combination of claim 7, wherein said shank portion has an exterior surface, and said exterior surface has a hexagonal cross sectional shape.

9. The combination of claim 7, further comprising:

each of said pair of opposing jaw members having an arm portion, said face portion being adapted for engaging a plurality of wires;

said arm portion having an aperture extending therethrough; and a rivet member for pivotally securing a first one of said pair of opposing jaw members to a second one of said pair of opposing jaw members, said rivet member being positioned through each one of said apertures.

10. The combination of claim 7, wherein said biasing means further comprises a tension spring having a coil portion and a pair of arm members, said rivet member being positioned through said coil portion, said arm members urging said face portions of said jaw members together.

11. The combination of claim 7, wherein each of said face portions includes a plurality of ridges for enhancing an engagement between said face portion and the plurality of wires being grasped.

12. The combination of claim 7, wherein said shank portion has an exterior surface, and said exterior surface has a hexagonal cross sectional shape;

each of said pair of opposing jaw members having an arm portion, said face portion being adapted for engaging a plurality of wires;

said arm portion having an aperture extending therethrough;

a rivet member for pivotally securing a first one of said pair of opposing jaw members to a second one of said pair of opposing jaw members, said rivet member being positioned through each one of said apertures;

wherein said biasing means further comprises a tension spring having a coil portion and a pair of arm members, said rivet member being positioned through said coil portion, said arm members urging said face portions of said jaw members together; and wherein each of said face portions includes a plurality of ridges for enhancing an engagement between said face portion and the plurality of wires being grasped.

* * * * *